US007931245B2

(12) United States Patent
Mills, Sr. et al.

(10) Patent No.: US 7,931,245 B2
(45) Date of Patent: Apr. 26, 2011

(54) PLATE HOLDER FOR CHILDREN AND HANDICAPPED PERSONS

(75) Inventors: Jesse Russell Mills, Sr., Salt Lake City, UT (US); Meghann Elaine Mills, Salt Lake City, UT (US)

(73) Assignee: LIL Diner, LLC, Salt Lake City, UT (US)

( * ) Notice: Subject to any disclaimer, the term of this patent is extended or adjusted under 35 U.S.C. 154(b) by 319 days.

(21) Appl. No.: 12/221,393

(22) Filed: Aug. 1, 2008

(65) Prior Publication Data

US 2010/0163695 A1 Jul. 1, 2010

Related U.S. Application Data

(60) Provisional application No. 60/962,910, filed on Aug. 2, 2007.

(51) Int. Cl.
*A47B 96/06* (2006.01)

(52) U.S. Cl. ..... 248/231.71; 248/316.1; 248/206.2

(58) Field of Classification Search ..... 248/231.71, 248/316.2, 316.1, 306, 305, 339, 206.2, 227.2, 248/346.01, 346.03; 220/574, 574.1, 483, 220/480, 476, 737, 325, 327, 328; 108/97, 108/98, 158.13; 269/143, 21, 249
See application file for complete search history.

(56) References Cited

U.S. PATENT DOCUMENTS

| | | | | |
|---|---|---|---|---|
| 121,444 | A * | 11/1871 | Leseman | 248/231.71 |
| 660,443 | A * | 10/1900 | Deal | 220/379 |
| 1,108,692 | A * | 8/1914 | Burd | 108/97 |
| 1,494,971 | A * | 5/1924 | Peters | 248/316.1 |
| 2,099,635 | A | 11/1937 | Toniolo | |
| 2,517,018 | A | 7/1945 | Nicholson | |
| 2,850,079 | A | 9/1958 | Prushnok et al. | |
| 3,142,470 | A * | 7/1964 | Iandiorio et al. | 248/507 |
| 3,697,033 | A * | 10/1972 | Jacobs | 248/231.71 |
| 3,746,295 | A * | 7/1973 | Stepanek et al. | 248/447.2 |

(Continued)

FOREIGN PATENT DOCUMENTS

JP 06-000230 U 1/1994

(Continued)

OTHER PUBLICATIONS

U.S. Appl. No. 12/637,617, filed Dec. 14, 2009, Jesse Russell Mills.

*Primary Examiner* — A. Joseph Wujciak, III

(74) *Attorney, Agent, or Firm* — Maschoff Gilmore & Israelsen

(57) ABSTRACT

A plate holder that attaches a dish to a structure using a suction device. The plate holder includes a three sided "C-shaped structure" that can be made of various hard materials and is composed of a top arm, a side arm, and a bottom arm. On the outer-end or the top arm is a notch or hole through which attaches a suction device facing upward that holds a dish so that it is not spilled by a child, handicapped person, wind, or movement of the structure. A circular protective skirt on the top arm sits just below the suction device and serves to balance the plate on the table. On the bottom arm is a hole through which runs a plastic screw with a handle on the outside used to secure and tighten the plate holder to the table. It can be adjusted for different structures by screwing or unscrewing.

11 Claims, 12 Drawing Sheets

U.S. PATENT DOCUMENTS

| | | | | |
|---|---|---|---|---|
| 4,662,676 | A | 5/1987 | Havelock | |
| 4,908,066 | A | 3/1990 | Taylor et al. | |
| 5,053,262 | A | 10/1991 | Kerr | |
| 5,641,140 | A | 6/1997 | Sorenson | |
| 5,842,671 | A | 12/1998 | Gibbs | |
| 5,996,957 | A | 12/1999 | Kurtz | |
| 6,065,604 | A | 5/2000 | Storck | |
| 6,216,605 | B1 | 4/2001 | Chapman | |
| 6,581,541 | B2 | 6/2003 | Hollinger | |
| 6,637,614 | B2 | 10/2003 | Bergkvist | |
| 6,746,735 | B2 | 6/2004 | Snedeker | |
| 6,962,314 | B2 * | 11/2005 | Hsu | 248/205.5 |
| 7,303,172 | B2 * | 12/2007 | Rich | 248/231.41 |
| 2006/0006181 | A1 | 1/2006 | Rich | |
| 2007/0034767 | A1 * | 2/2007 | Mastropaolo et al. | 248/447.2 |
| 2008/0245947 | A1 | 10/2008 | Webb et al. | |

FOREIGN PATENT DOCUMENTS

| | | | |
|---|---|---|---|
| JP | 09-206195 | A | 8/1997 |
| WO | 02/005995 | A1 | 7/2002 |
| WO | WO 2006/004737 | A1 | 5/2006 |

* cited by examiner

PLATE HOLDER FOR CHILDREN AND HANDICAPPED PERSONS

CROSS-REFERENCE TO RELATED APPLICATIONS

This application claims the benefit of U.S. provisional patent application Ser. No. 60/962,910 filed Aug. 2, 2007, the contents of which are hereby incorporated by reference herein.

FIELD OF INVENTION

The present invention pertains generally to holders and clamps and more specifically to plate holders.

BACKGROUND

Many situations exist where food dishes or other articles can fall, spill or otherwise be upset because they are not securely held. For example, a young child having a meal in a restaurant may upset or spill the contents of a plate or other food container or may knock a dish off of the table. The problems of securely retaining dishes are not restricted only to small children. Adults with motor control deficiencies may also have trouble using unsecured dishes. In addition, eating in a moving environment such as in a vehicle, watercraft, aircraft or other moving environments using conventional unsecured dishes without holders may lead to spills or breakage. In restaurant and similar settings, preventing spillage from a plate or a bowl is a challenge for many parents and caregivers, who often resort to holding a child's plate by hand to keep it from being tipped, spilled, or knocked off. Alternatively, dishes and bowls are not used at all and food for children is placed directly on the table or on a paper placemat provided by the restaurant.

Having a child eat directly from a table surface has a number of negative consequences. The table surface may be unsanitary and may contain germs or chemical residues that may contaminate the child's food. Further, cleaning up the table after a child has eaten directly from the surface may be difficult and messy. There are also many occasions where eating directly from the table surface would be impolite or impractical such as when the table is covered with a tablecloth. Using utensils to scoop food directly from a table surface is difficult so the child often uses fingers instead of utensils, making cleanup more difficult and delaying the process of learning to use utensils properly. Eating from a paper placemat or other placemat that is not designed to contain food may be unsuitable for foods that contain liquid or are runny.

Prior arts have attempted to solve these problems but so far they all fall short. A summary of the prior art is included at the end of this section. One alternative to eating directly from the table or from a restaurant placemat is to use a placemat that is designed to contain food and attach to a table. Some existing placemats do not have a method of attaching to the table, therefore resulting in the placemat and the food contents being thrown to the floor. Other existing placemats for children have suction cups which secure the placemat to an airtight smooth table top. However, such placemats fail to secure the placemat to table tops that are not sufficiently smooth and airtight to permit a sufficient vacuum to be created by the suction cups. Further, the suction cups on the placemat do not create a sufficiently strong hold and most children will learn quickly how to remove the placemat from the table. Placemats have the disadvantage of not being suitable for use with utensils as described above. Further, after a child has eaten on a placemat, it must be folded or rolled up and carried home to be washed. Existing placemats are bulky to carry and food residue may soil clothing or bags in which the placemat is carried. Existing placemats are made of non-durable materials that are stained easily and that are so soft they can even be bit through by a young, teething child, which is an obvious choking hazard. Because of the lack of durability, the existing placemats must be replaced often.

Some existing non-spill dishes for children have suction cups attached directly to the bottom of the dish. The suction cups may be pressed against a smooth table surface such that the resulting suction is intended to retain the dish in place. Suction cup dishes have numerous disadvantages. Suction cup dishes often have easily accessible suction release tab so that a parent may remove the cup. Many children learn to pull the release tab or otherwise release the suction and then are able to upset the dish. Suction cup dishes have the further disadvantage that the suction function does not work correctly unless a smooth upper surface is available on the table top. For example, the suction cup cannot attach to outdoor tables that have a grating table-top or to some tile-top or other textured tables. Likewise, the suction cups fail to adhere to tablecloths or similarly porous surfaces. Suction cup dishes will not work with many picnic tables or other tables with slots, tiles, holes, rough surfaces or uneven surfaces. Also, suction cup dishes, like placemats, have to be cleaned immediately after eating or carried home for cleaning each time they are used, which is both messy and inconvenient.

Some existing plate holders for children require that Velcro or other attaching material be applied to the dish before it will adhere to the plate holder. This can be problematic for a number of reasons. First, if the material is applied to a restaurant dish, there is a risk of damaging the dish. Further, if the parent takes this approach, it requires a new piece of material for each new dining experience, which can be costly and inconvenient. The parent may also choose to use their own dish with the Velcro already attached, so that they don't have to use a new piece of material each time. However, this means that the parent must immediately clean the dish after use or carry the dish home for cleaning each time. As mentioned before, this is a messy alternative and very inconvenient. Parents have too much on their minds these days to have to remember to keep a clean dish with adhesive material attached ready in the diaper bag for each time they dine out. Overall, people who use devices that require additional materials each use usually find that they cannot get the use out of it that they originally desired because they are constantly running out of essential materials or have to replace the item so frequently that it is not worth the money.

The present invention is unique for several reasons. With the present invention, nearly any restaurant dish can be used so there is no dish to clean or carry home. Since no part of the present invention actually touches any food, it will require only minimal cleaning, such as wiping off with a disposable baby wipe from the diaper bag. As mentioned before, nearly all of the prior art requires cleaning of dishes or other materials with dish soap and hot water each and every time the art is used. The user has to choose to either carry around dish soap in order to wash the device in the public restroom following the meal, or to carry the device home dirty and hopefully remembering to wash it before the next time it is needed. This is inconvenient, messy and unsanitary. Also, the present invention avoids the cost and inconvenience of having to use additional materials. The present invention functions alone, and since it is designed to be produced inexpensively and to last for potentially thousands of uses, it is the easiest, the most economical and the most practical solution. Further, while prior art has attempted to use suction as a means of keeping a dish on the table, none have approached the use of suction in the same way as the present invention. The present invention is different because the suction device is not a physical integration of the dish itself in an effort to hold the entire dish structure to the table, but instead the suction is used as a means of attaching restaurant dishes to the table. The actual holding of the present invention to the table does not require the use of suction, and therefore it fits to almost any table, without the need for the surface to be smooth and non-porous. The only real requirement with the present invention is that the restaurant or dining facility has a dish with a relatively solid portion on the bottom. It is likely that this type of dish can be found in almost every restaurant. The dish can be made of nearly any material—even a coated paper plate will do. The present invention is the only approach to the problem of keeping a young child or handicapped person's dish on the table that allows the user the convenience and ease of using a restaurant dish, that does not require additional materials, that does not create the potential of damaging restaurant property, that does not require frequent cleaning and that has the level of hold necessary to ensure the child will not be able to remove the dish.

Examples of prior art that attempt to address the issue of keeping the plate on the table but that are not as advantageous as the present invention include the following:

1) Secure dish holder. U.S. Pat. No. 7,303,172: Comprises a device that secures to the table and utilizes Velcro as a means of attaching a dish to the device. This device requires that either the user apply of a new piece of Velcro to the bottom of each restaurant dish before the dish can be attached to the device or the use of a dish from home with Velcro previously attached. If the user elects to carry around the dish with Velcro previously attached that is included with the device, the user must thoroughly clean the dish after each use. If the user desires to use the restaurant plate, the user must carry around extra Velcro strips at all times. If the user unexpectedly runs out of Velcro or forgets to replenish his supply, he will not be able to attach a restaurant dish when needed. Further, if the user desires to use the device frequently with restaurant dishes, the required replacement of the Velcro can become costly over time. Also, the user risks damaging restaurant property when removing the Velcro from the dish. Further, the strength of the Velcro attachment is not as strong as that of the suction device on the present invention.
2) Standard Disposable Placemat: A person desiring to feed their child at a restaurant may attempt to use a standard paper or plastic placemat. This method requires that the user attach the placemat with tape or by other means in order to prevent the child from pulling the placemat off the table. Even if the placemat is attached to the table, the child will likely be able to rip or tear the inexpensive material from which it is composed. Also, the material will likely not hold up to the moisture or heat of most foods. Further, this solution requires a new placemat every time and can therefore be costly over time.
3) Placemat member, U.S. Pat. No. 6,746,735 or Child's serving mat, U.S. Pat. No. 5,053,262: Comprises a serving placemat with multiple small suction cups on the bottom. These devices require a thorough cleaning after each use. These devices are difficult to clean in a small public sink because of its size and structure, and the material stains easily and absorbs odor so it has to be replaced often. Further, when made of rubber the mat can be easily bitten through by a young teething child and can therefore become a choking hazard. Further, the small suction cups on this device do not provide the level of suction necessary to keep it on the table, so a young child will be easily able to remove it from the table. Further, the suction cups on the device require that the surface of the structure to which it is being attached is smooth and non-porous, which is not the case for many tables.
4) Child's plate, U.S. Pat. No. 6,637,614: Comprises a plate that is physically designed to be difficult for a young child to grip and with friction enhancements on the bottom of the plate to prevent slippage. This plate does not attach to the table but relies only on decreased friction and the child's inability to grip the side, which can easily be overcome by a stubborn and determined child. Like other prior art, this plate must be cleaned thoroughly after each use. This device is not as durable as the present invention and therefore requires frequent replacement, which can be costly.
5) Pet bowl with suction cup. U.S. Pat. No. 6,581,541: Comprises a dish with a large suction cup on the bottom. While originally designed for pets, this design has also been used for bowls for young children. This type of dish must be cleaned thoroughly after each use and requires that the surface to which it is attached is smooth and non-porous. Further, this type of device is not as durable as the present invention and therefore requires frequent replacement, which can be costly.

SUMMARY OF THE INVENTION

The present invention provides a plate holder for use with various types of table tops and other surfaces and by allowing for the parent to use the restaurant dish, so that it does not require any cleaning of dishes or trays after use. The present invention is also more durable, more easily produced at a reasonable cost, more compact and more easily portable.

One embodiment can include a plate holder that is adapted to be attached to a structure including a flattened C-shaped structure making up a top arm, a side arm and a bottom arm, resembling a C-clamp with a flattened top arm and bottom arm; the top arm having a topside and a bottomside with a suction device attached to the top arm and the suction end of the suction device facing outward from the topside of the top arm, such that a dish may be attached to the suction device; between the suction device and the top arm, a detachable and optional skirt to assist in balance of any attached dish and to dampen sound if dish is struck; a slip-resistant padding attached to the bottomside of the top arm; a screw or other fastening mechanism, the screw passing through a comparably riveted and sized hole on the bottom aim, passing up through the bottomside towards the top arm, so that the structure may be fastened to a table top when tightened.

Another embodiment can include a method of manufacturing and assembling a plate holder for securely holding a dish to a structure comprising: forming a C-shaped structure comprising a top arm, a side arm and a bottom arm with a divot or notch or hole in the top arm and a riveted hole and inward support extension on bottom arm; the bottom arm having a topside and a bottomside and the top arm having a topside and a bottomside; forming a screw of compatible dimensions with the riveted hole; forming a suction device, more commonly referred to as a suction cup, with a nipple-like protrusion on the non-suction end; forming a skirt with compatible dimensions with the top arm, the skirt being a flat circular piece of material with a small hole in the center and a folded over lip around the outer edge of the skirt, with the lip facing downward and a small omission in the fold over, threading the screw through the riveted hole in the bottom arm, passing through the bottomside of the bottom arm so that the screw extends perpendicularly from the bottomside of the bottom arm and toward the top arm, parallel with the side arm; fixing slip resistant padding to the bottomside of the top arm; positioning the protrusion of the suction device down and through the hole of the skirt; sliding or fastening the protrusion of the suction device through the divot or notch or hole of the top arm such that the skirt and the suction end of the suction device are positioned on the topside of the top arm, and such that the omission of the lip in the skirt is positioned over the top arm.

Another embodiment includes a method of securely holding a plate or other dish by providing a plate holder comprising: a C-shaped structure comprised of a top arm, a side arm, and a bottom arm; the top arm having a topside and a bottomside; the topside of the top arm having attached a suction device to the topside of the top arm, a skirt attached in between the top arm and the suction device, and a slip-resistant padding attached to the bottomside of the top arm; the bottom arm having a topside and a bottomside; the screw passing through a riveted hole in the bottom arm, passing through the bottomside of the bottom arm, perpendicular to the bottom arm and parallel to the side arm; the riveted hole having a diameter and rivet size that is complimentary to the screw; the C-shaped structure being positioned such that the side arm is flush with the edge of the table, counter or other such structure upon which the user will be dining; the screw being tightened such that the C-shaped structure is to become locked in position on the table, to securely attach the plate holder as a result of a force on the top arm and the screw. A plate or other dish attaches firmly to the suction device but gently pushing the dish downward over suction device.

BRIEF DESCRIPTION OF THE DRAWINGS

FIG. 9 illustrates the C-shaped structure of the embodiment of FIG. 1;

FIG. 9(*a*) illustrates a side view of C-Shaped structure;

FIG. 9(*b*) illustrates a top view of C-Shaped structure;

FIG. 9(*c*) illustrates a front view of C-Shaped structure;

FIG. 9(*d*) illustrates a bottom view of C-Shaped structure;

FIG. 9(*e*) illustrates a back view of C-Shaped structure;

FIG. 10 illustrates the skirt structure of the embodiment of FIG. 1;

FIG. 10(*a*) illustrates a side view of skirt shaped structure;

FIG. 10(*b*) illustrates a top view of skirt shaped structure;

FIG. 11 illustrates the screw structure of the embodiment of FIG. 1;

FIG. 11(*a*) illustrates a side view of screw shaped structure;

FIG. 11(*b*) illustrates a top view of skirt shaped structure;

in FIG. 12 is using a teeth slide and lock mechanism.

FIG. 12(*a*) illustrates a a teeth slide and lock mechanism.

DETAILED DESCRIPTION OF THE INVENTION

Figure 1:
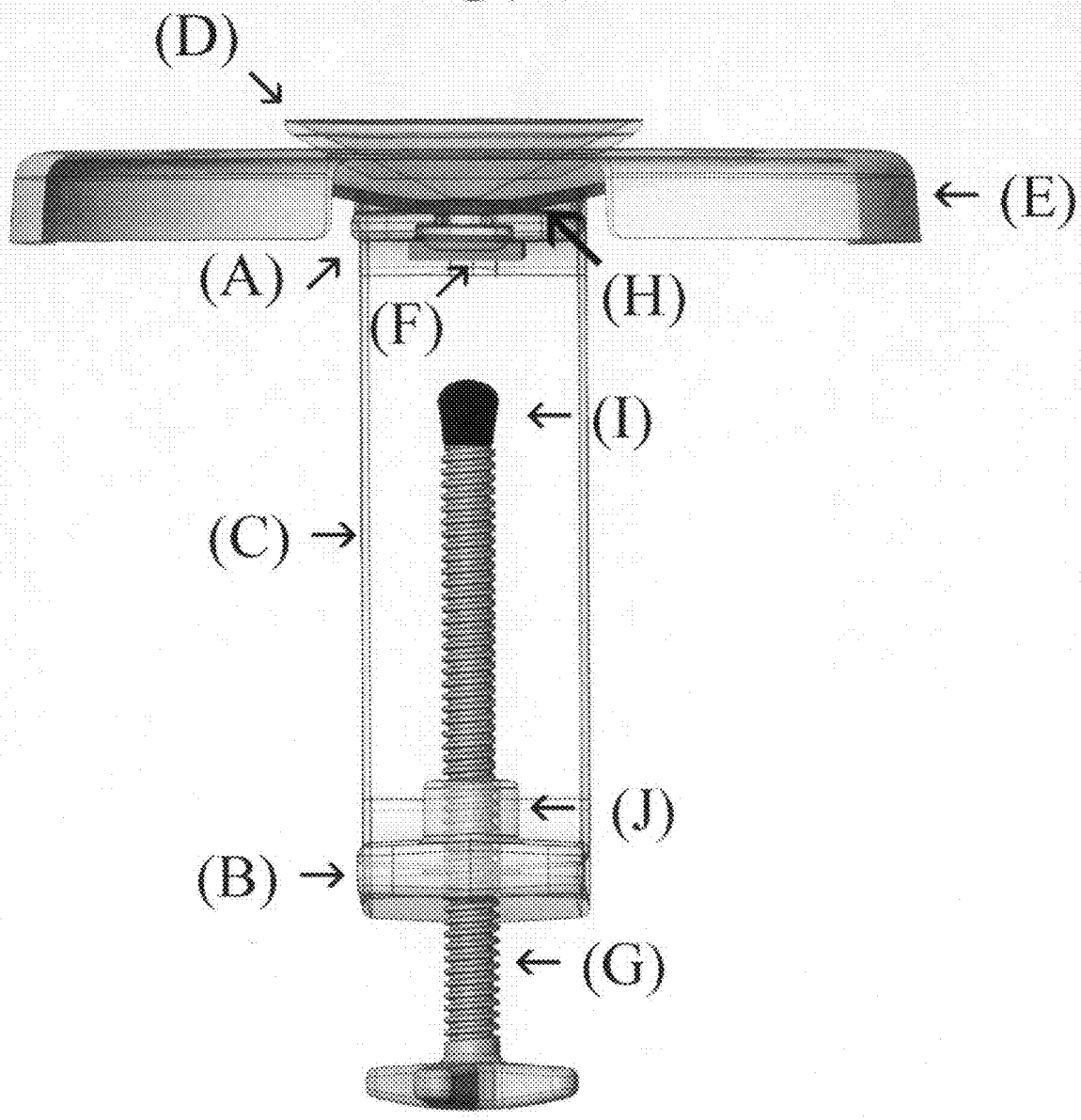
FIG. 1 is an illustration of a front view of an embodiment of a plate holder in an open position.

FIG. 1 is an illustration of a front view of an embodiment of a plate holder in an open position. The embodiment is composed of a flattened and tapered C-shaped structure, making up a top arm (A), a side arm (C), and a bottom arm(B); the top arm (A) having a suction device (D) attached to the top arm notch (H); between the suction device (D) and the top arm (A), a detachable skirt (E) to assist in balance of any attached dish and to dampen sound if dish is struck; a slip-resistant padding (F) attached to the bottomside of the top arm (A); a screw (G) passing through a comparably riveted and sized hole (J) on the bottom arm (B), passing up through the bottomside of the bottom arm (B) and towards the top arm (A), so that the structure may be fastened to a table top when tightened. Endcaps (I) may be any separately manufactured components such as rings, pins, blocks, spheres or other structures that can be fixed to the end of the screw (G) to prevent the screw (G) from being removed or to assist in tightening the plate holder to the structure. Alternatively, the endcap (I) may be integral parts of the screw (G) which are formed with retaining structures or protrusions extending outward from the screw (G), or a portion of the screw (G) may be sized larger than the remaining portion of the screw (G) so that the screw (G) cannot be removed. Further, endcaps may be omitted altogether which allows the plate holder to be broken down into its parts and easily stored and transported.

The C-shaped structure comprising the top arm (A), the side arm (C) and the bottom arm (B), the screw (G), and the skirt (E) may be made of plastic MITS, Chemlon, LDPE, acrylic or other hard plastic-like materials. Other hard materials such as wood or metal may be used. In the embodiment in FIG. 1, the height of the top arm (A) is 0.25 inches which resists breakage and provides a solid, but unobtrusive surface. Thicknesses in the range of 0.2 inches to 0.5 inches may be suitable for plastic or acrylic. In the embodiment in FIG. 1 the diameter of the screw is 0.375 inches and the length is 4.56 inches which resists breakage and minimizes size. Lengths in the range of 2 inches to 7 inches and diameters in the range 0.1 inches to 0.8 inches of may be suitable for plastic or acrylic. C-shaped structures with other thicknesses and screws with other lengths and diameters may be effectively used depending on the strength, cost, and manufacturability of the materials. Suitable plastics for the C-shaped structure, the screw (G), the skirt (E) and the endcap (I) may be obtained from numerous sources, including Utah Plastics Groups at 2700 South 900 West Suite D. Salt Lake City, Utah 84119. The suction device may be made from silicone, or easily obtained from numerous sources, including Adams Mfg. Co. at 109 West Park Road. Portersville, Pa. 10651.

The bottom arm (B) may be the same thickness as the top arm (A) or may differ in thickness. The C-shaped structure comprising the top arm (A), the side arm (C) and the bottom arm (B), the screw (G), the skirt (E), and the suction device (D) may be clear, translucent, opaque, or any desired color.

As shown in the embodiment of FIG. 1, the top arm (A) and the bottom arm (B) have a long, rounded rectangular shape, and the embodiment has the top arm (A) with a length of approximately 4.63 inches lengths in the range of 1.5 inches to 7 inches would also be suitable, and a width of approximately 1.5 inches, and the embodiment has the bottom arm with a length of approximately 2.75 inches and a width of approximately 1.5 inches. The rounded corners of the embodiment reduce the chance of a corner breaking or someone getting poked by a sharp corner. The size of the top arm (A) in this embodiment provides sufficient surface area for the attachment of the suction device (D) and to accommodate and securely retain various shapes and sizes of dishes or other articles. At the same time, the size is small enough so that the plate holder does not protrude excessively into the table area and so that the plate holder is easily portable. The top arm (A) and the bottom arm (B) may have any desired shape or size.

In accordance with the embodiment of FIG. 1, the bottom arm (B) has a width of approximately 1.5 inches. Widths in the range of 0.5 inches to 3 inches would also be suitable. The length of the bottom arm (B) is approximately 2.75 inches. Lengths in the range of 1.5 inches to 6.75 inches would also be suitable. The length in the embodiment allows the bottom arm (B) to extend far enough under a table or other structure to accommodate various table top or structural designs and ensure a tight fit. The length of the bottom arm (B) in the embodiment also allows a parent to easily reach under the table and tighten or un-tighten the screw (G).

The hole (J) in the bottom arm has a diameter which is comparable to the diameter of the screw (G). In the embodiment of FIG. 1, the diameter of the hole (J) is approximately 0.375 inches and the screw (G) has a diameter of approximately 0.375 inches. Others may have larger diameters of the hole (J) and the screw (G), depending on the type and size of the materials used. The hole (J) in this embodiment is approximately 0.3 inches from the end of the bottom arm (B), i.e., the edge that is facing toward the table or structure to which the plate holder is being attached. Distances in the range of 0.1 inches to 4 inches would also be suitable.

The embodiment of FIG. 1 includes one screw (G). However, more than one screw may be used or a different mode all together of attaching the plate holder may be used, such as spring loaded clamp, a push-pin release device, a trigger-release pressure device, a teethed catch and release device (12*a*), or other similar mechanisms. As long as the plate holder contains a top arm (A) with a suction device (D), and the top arm (A) is held firmly to the table by whatever means, the desired purpose of the invention will be achieved. Using one screw (G) allows for a tight hold to the table and the length of the screw (G) in this embodiment is 4.56 inches and is large enough to accommodate many structure thicknesses, and at the same time small enough for the plate holder to be easily transportable in a diaper bag, purse or other small container. Other lengths of screw may be used.

The suction device (D) may be made from silicone or similar material, and may be obtained from many sources such as Adams Mfg. Co. at 109 West Park Road. Portersville, Pa. 10651. Suction devices vary depending on the material of which they are composed and their exact structure, and as such have varying degrees of holding strength. The holding strength of the suction device (D) should be such that the attached dish or article is securely retained. Many suction devices include a small extension at the outer edge of the suction part, allowing for easy removal of the attached dish or article. To provide a sanitary and attractive surface, suction devices can be washed and cleaned and can also be easily replaced if necessary, at very little cost.

Slip-resistant padding (F) protects the surface of a table, or other structure to which the plate holder is attached, from being marred or scratched by the top arm and also allows a more secure attachment. The slip-resistant padding (F) may be die cut or otherwise formed to fit the size of the top arm (A). One source of slip-resistant padding is Griptex Industries, Inc., 63 Industrial Drive Cartersville, Ga. 30120. It is not necessary that the padding completely cover the bottom of the top arm (A), but should cover enough to securely hold the top arm (A) on the surface of the structure to which the plate holder is attached and not mar the surface. The slip-resistant padding (F) has dishwasher safe adhesive that withstands numerous washings.

The C-shaped structure comprising the top arm (A), side arm (C) and bottom arm (B), the suction device (D), the skirt (E), and the screw (G) can all be taken apart and put back together easily by an adult. This provides lower assembly and shipping costs. Likewise, disassembly of plate holder permits more convenient storage and transportation for users. All parts of the plate holder may be made of materials that are safe for contact with food such as FDA approved plastic or other safe materials.

Precise forms of injection molding or other types of high precision molding can be used to manufacture the C-shaped structure, the screw (G), and the skirt (E). Molding can also be used to manufacture other component pieces of the plate holder including the suction device (D) and the endcaps (I). When injection molding is used, writing or other graphics may be incorporated into the mold. Writing that is incorporated directly into the plate holder, by laser engraving, molding, or other permanent processes, is durable and generally unaffected by repeated use and cleaning. Any desired type of writing, graphics or indicia may be incorporated.

Figure 2:
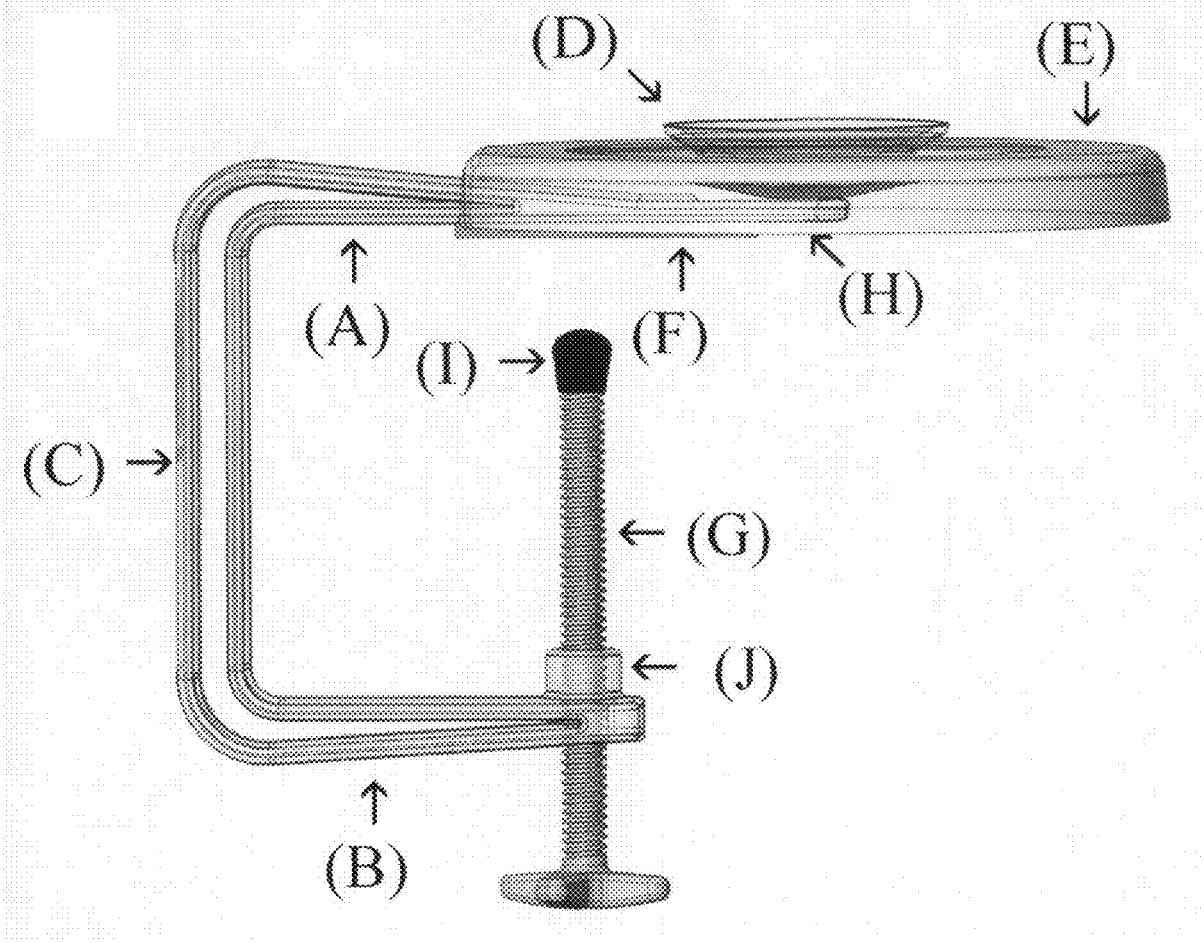
FIG. 2 illustrates a side view of the embodiment of FIG. 1.

FIG. 2 illustrates a side view of the embodiment of FIG. 1. The skirt (E) is attached to the top arm (A) and sits between the top arm (A) and the suction device (D), supporting the attached dish by ensuring that the system is substantially flush with the table or other surface. In this embodiment the skirt (E) has a diameter of 6 inches, which is large enough to support most dishes but small enough to be easily transported. Other sizes of skirt may be used. The attachment of the skirt (E) prevents the dish from moving around too much while the child is eating, and also absorbs the energy produced when a child pounds on the dish, which would otherwise cause a loud noise as the dish met the table. It also reduces the ability of a child to accidentally or intentionally stick his fingers under the dish and try to remove it.

Figure 3:
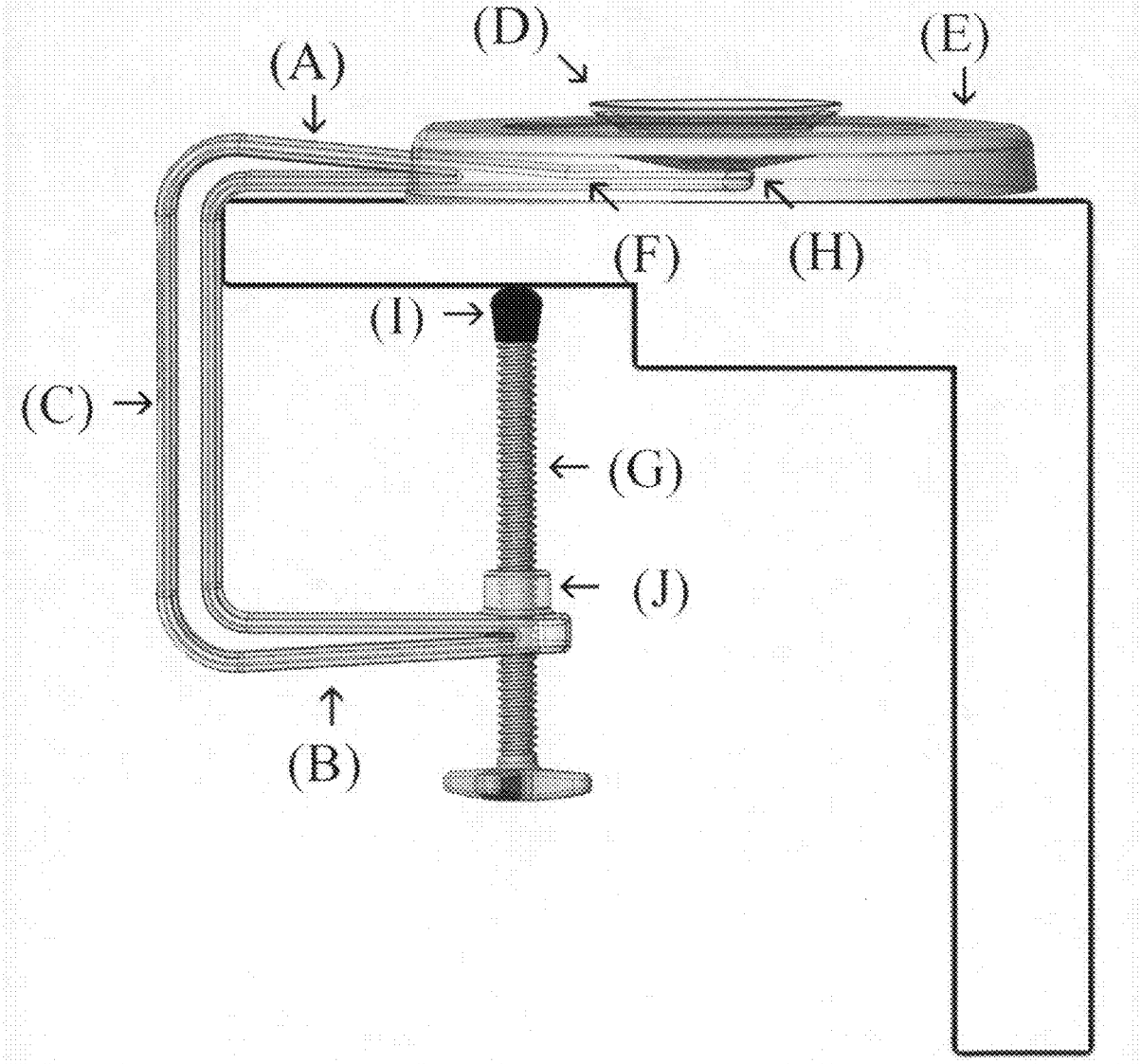
FIG. 3 is a side view of the embodiment of FIG. 1 attached to a structure.

FIG. 3 illustrates a side view of the embodiment of FIG. 1 attached to a structure. The embodiment in FIG. 3 is attached to the structure by a user turning the screw so that the end of the screw and the bottom of the top arm are compressed against the structure. The embodiment is released by turning the screw (G) in the opposite direction. The plate holder can be attached to many different structures, including but not limited to restaurant tables, wooden and plastic picnic tables, metal tables, glass tables, strollers, and many others.

Figure 4:
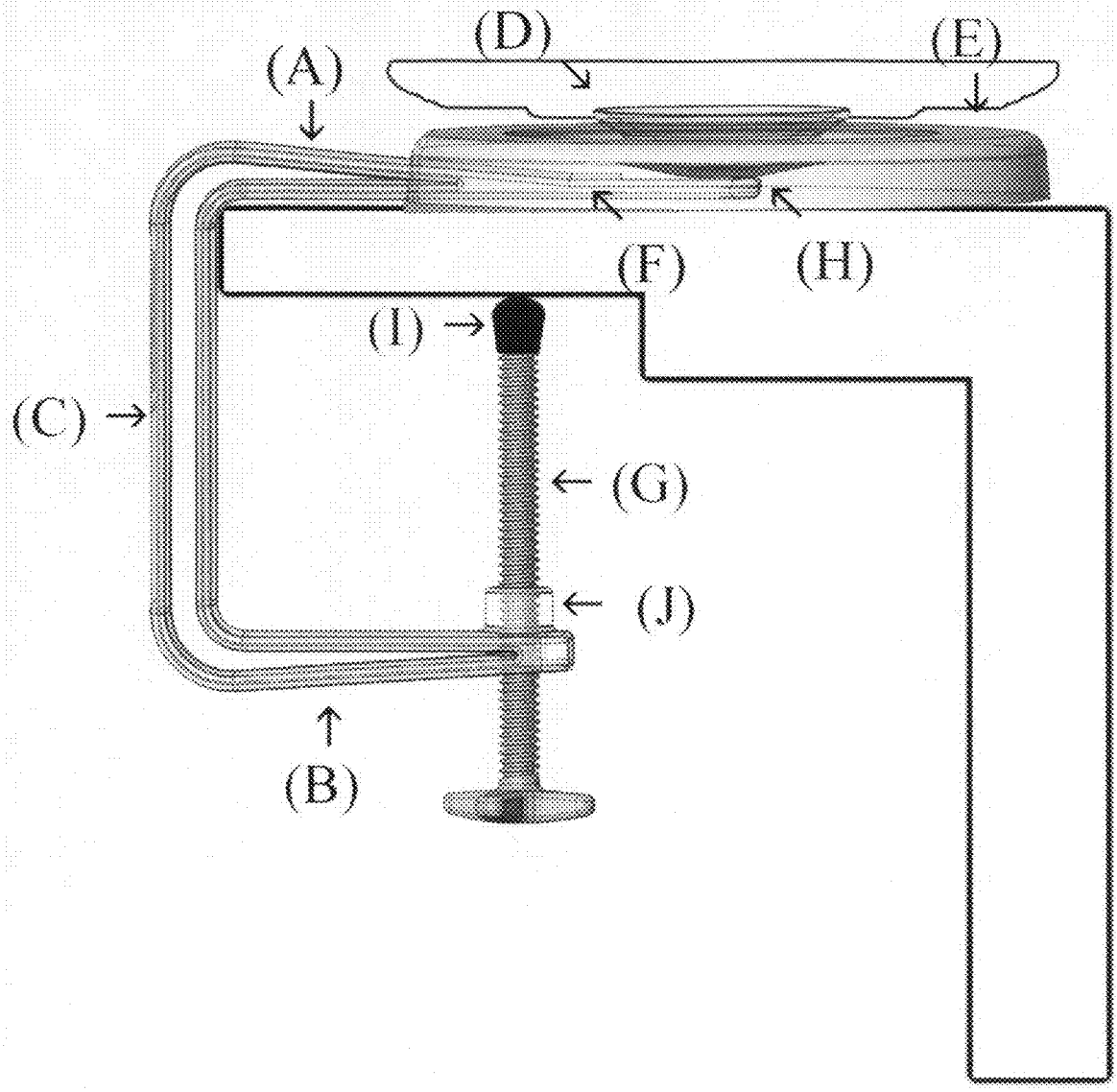
FIG. 4 is a side view of the embodiment of FIG. 1 attached to a structure with a dish attached to the suction device.

FIG. 4 illustrates a side view of the embodiment of FIG. 1 attached to a structure. In this embodiment, a dish is attached to the suction device (D). The diameter of the bottom of the dish is slightly larger than the diameter of the suction device (D), though most dishes will be significantly larger than this dish. The dish is fastened to the top arm (A) by means of the suction device (D), simply by pushing the dish atop the suction device (D) until it sticks. Nearly all types of dishes can be attached to the plate holder, including but not limited to glass bowls and plates, ceramic bowls and plates, plastic bowls and plates, plastic baskets with solid bottoms, children's divider trays, coated paper and plastic plates, china/porcelain bowls and plates. The plate holder is secured so that the table is positioned between the top arm (A) and the screw (G). The screw (G) is tightened toward the structure, causing the screw (G) and the top arm (A) to push toward the structure in opposite directions, which securely attaches the plate holder to the table. Slip-resistant padding (F) on the bottom of the top arm (A) grips the top of the table and also protects the surface of table from being scratched by the top arm (A).

Figure 5:
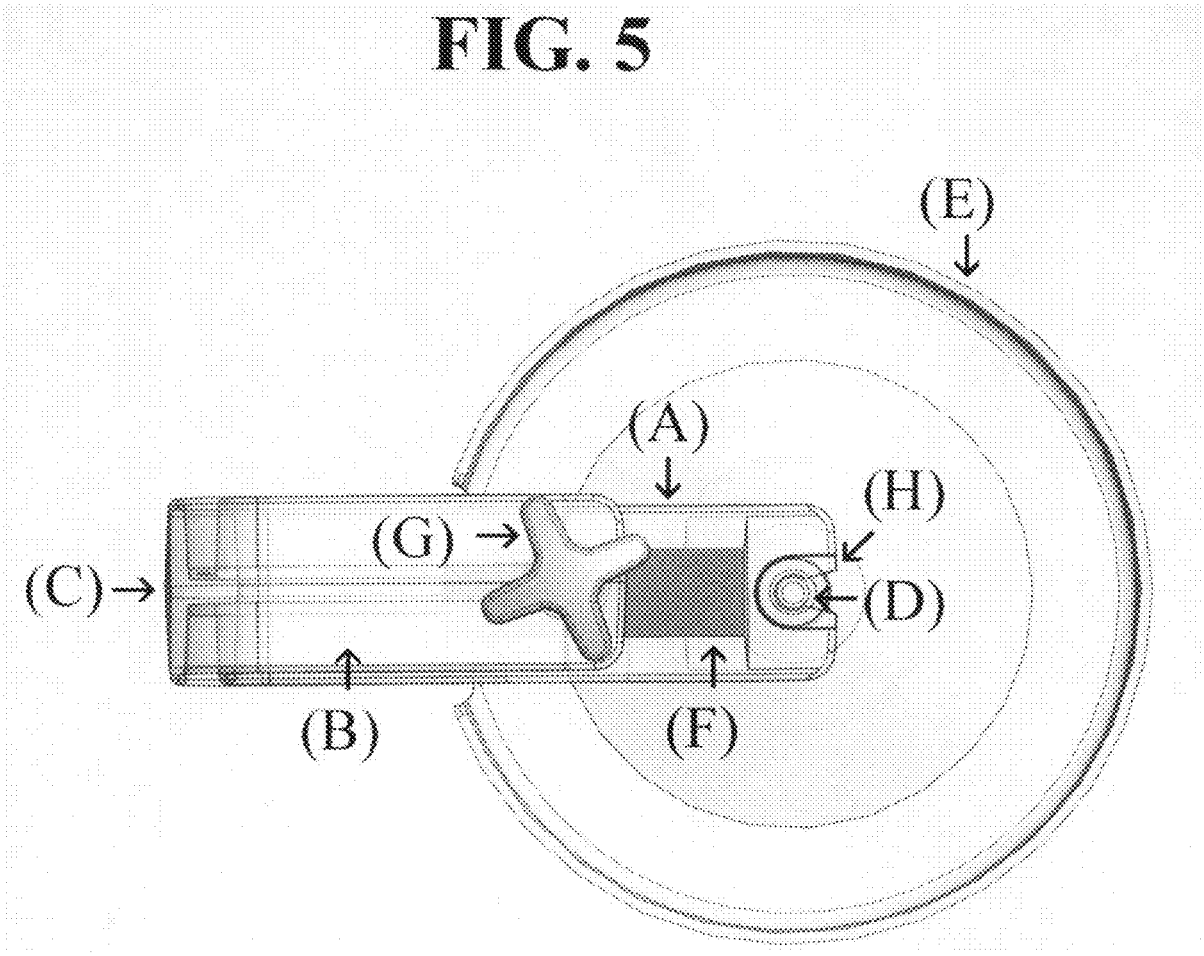
FIG. 5 illustrates a bottom view of embodiment of FIG. 1.

FIG. 5 illustrates a bottom view of the embodiment of FIG. 1. The screw (G) handle can be many different shapes provided it allows for easy turning.

Figure 6:
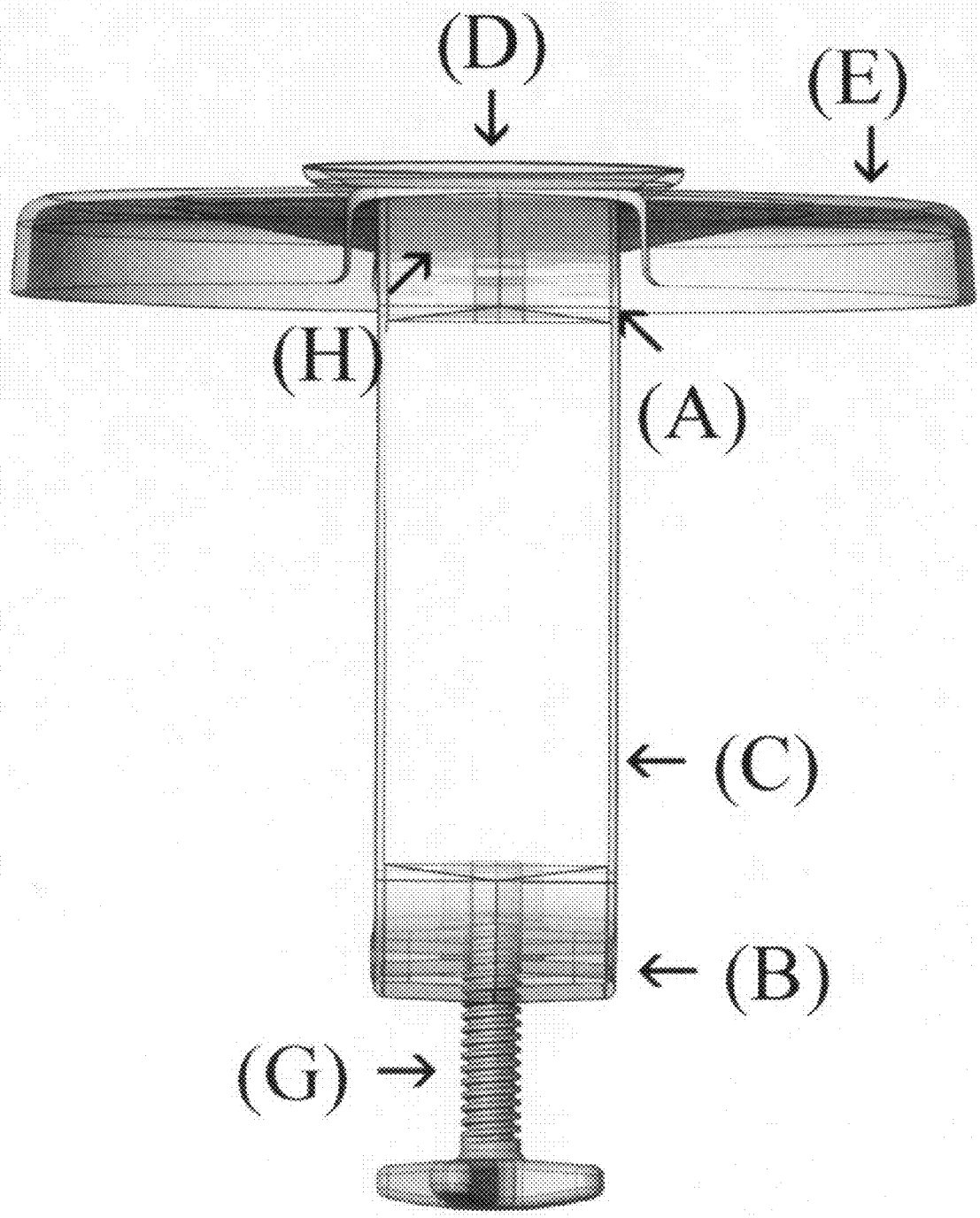
FIG. 6 illustrates a back view of embodiment of FIG. 1 attached to a structure with a dish attached to the suction device.

FIG. 6 illustrates a back view of the embodiment of FIG. 1 attached to a structure. In this embodiment, a dish is attached to the suction device (D).

Figure 7:
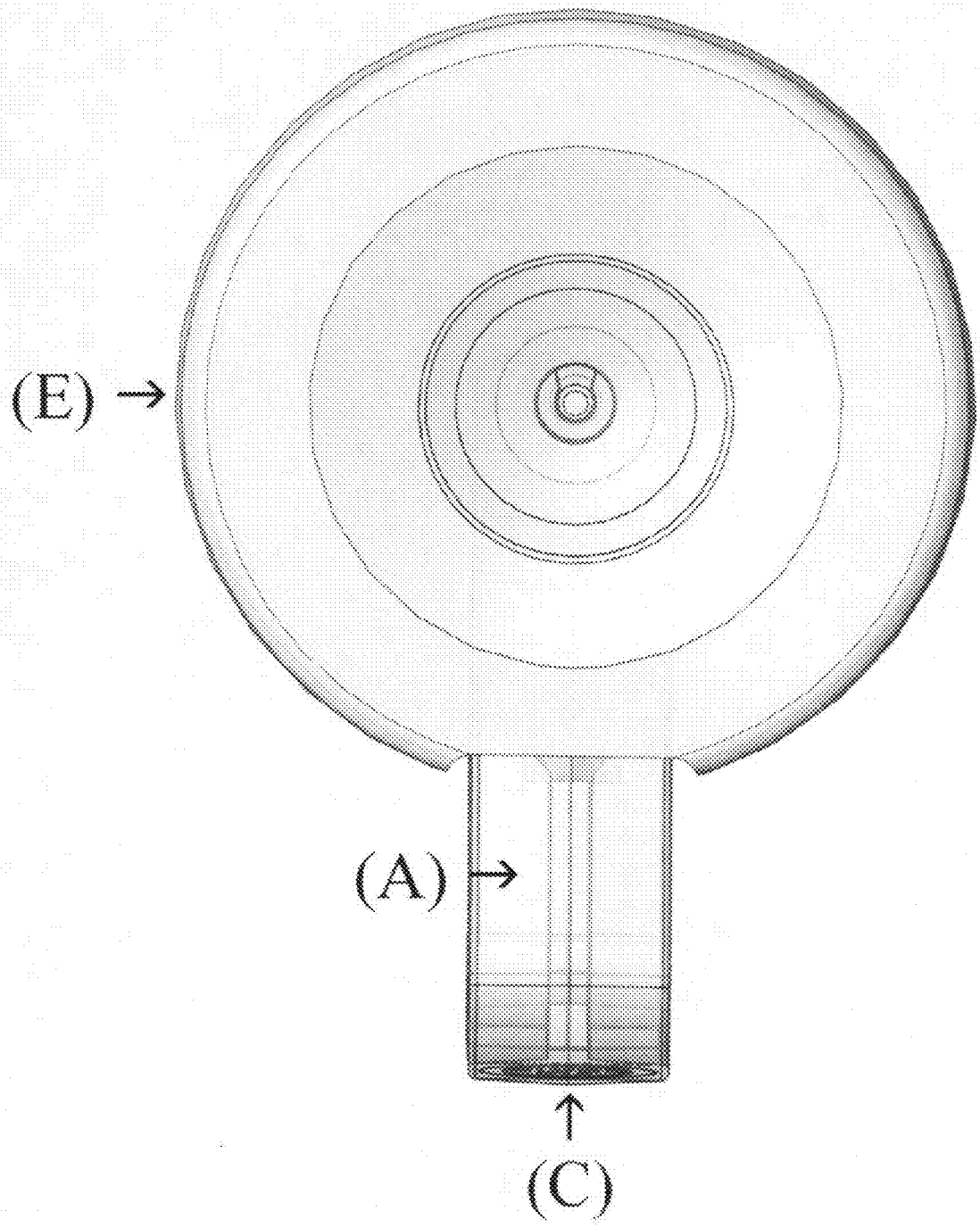
FIG. 7 is top view of the embodiment of FIG. 1.

FIG. 7 illustrates a top view of the embodiment of FIG. 1.

Figure 8:
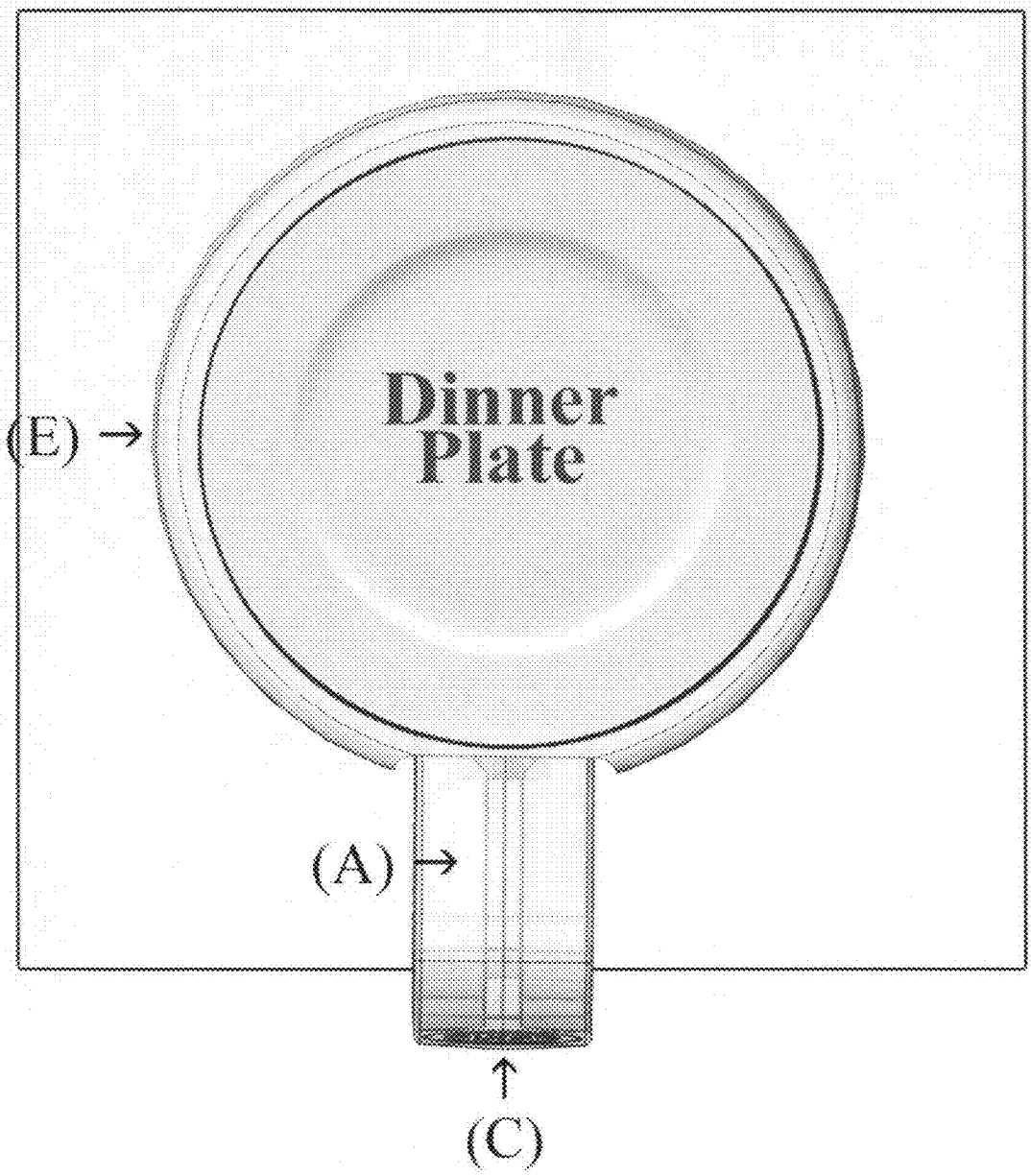
FIG. 8 is top view of the embodiment of FIG. 1 attached to a structure with a dish attached to the suction device.

FIG. 8 illustrates a top view of the embodiment of FIG. 1 attached to a structure. In this embodiment, a dish is attached to the suction device (D).

Figure 9:
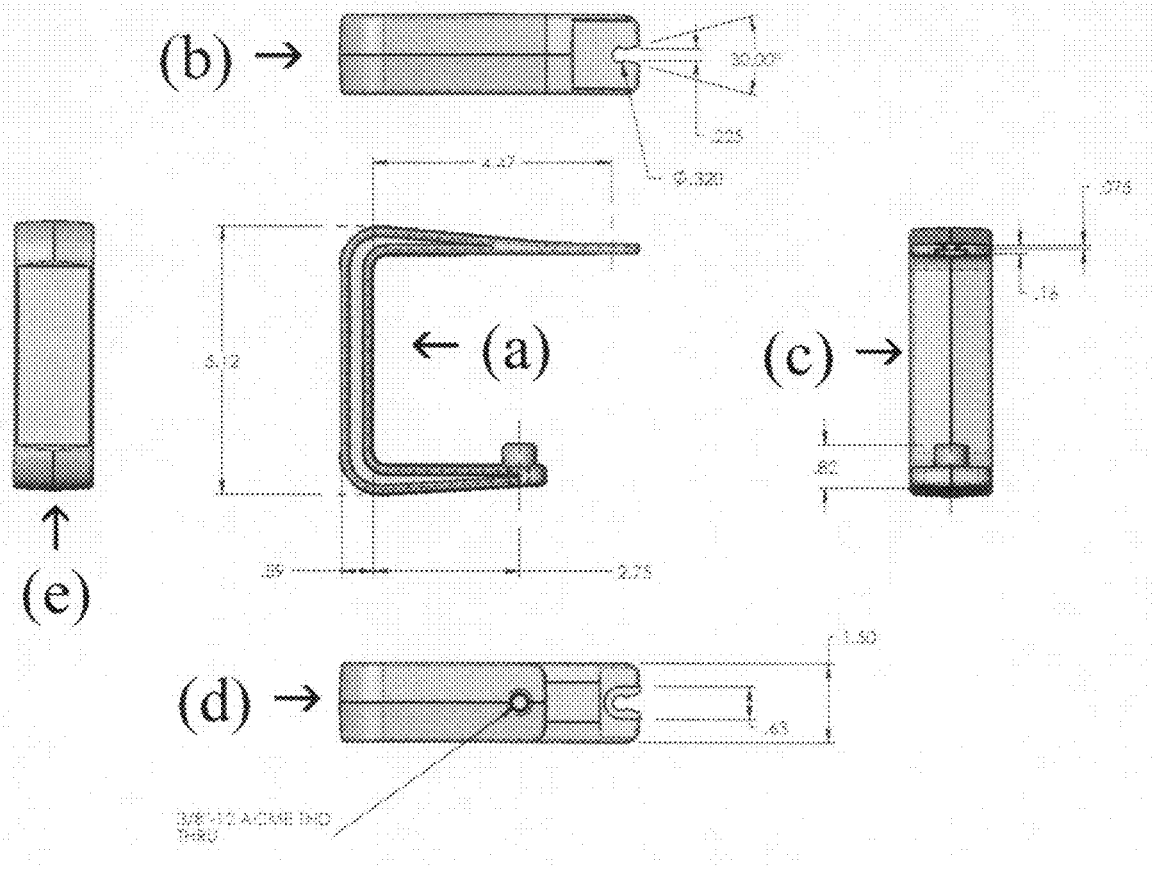
FIG. 9 is an illustration of the embodiment of FIG. 1, dissembled into its individual component, including: C-shaped structure, making up a top arm (A), a side arm (C), and a bottom arm (B)
Figure 10:
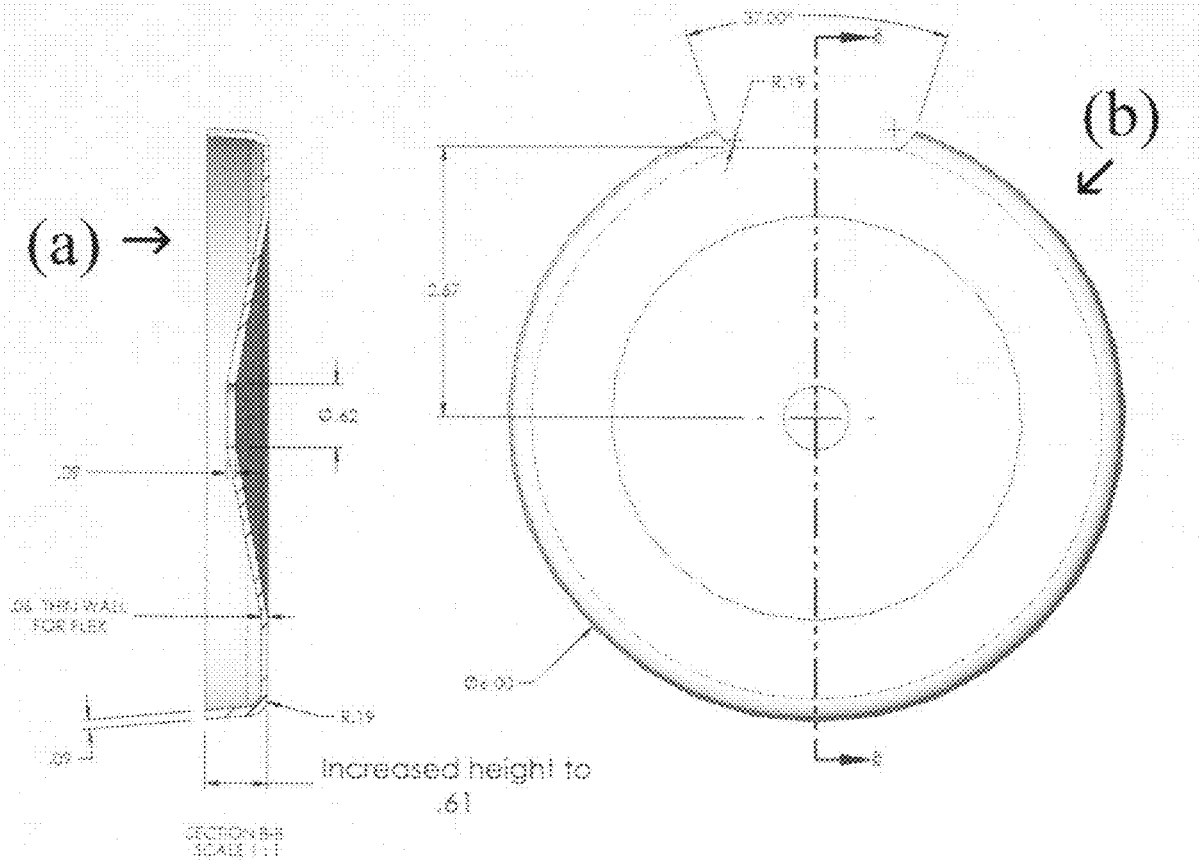
FIG. 10 is an is an illustration of the embodiment of FIG. 1, dissembled into individual component, including: skirt shaped structure.
Figure 11:
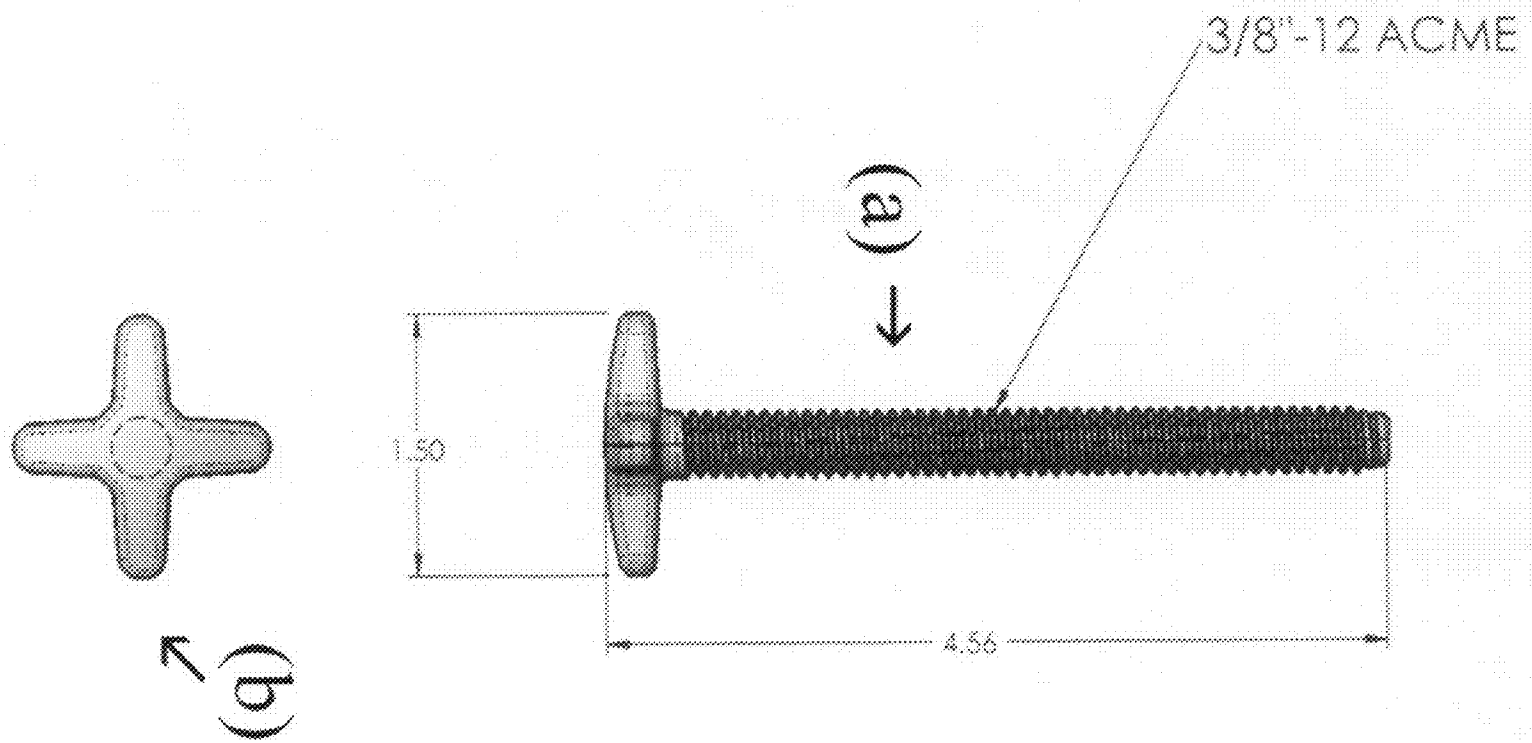
FIG. 11 is an illustration of the embodiment of FIG. 1, dissembled into individual component, including: screw.
Figure 12:
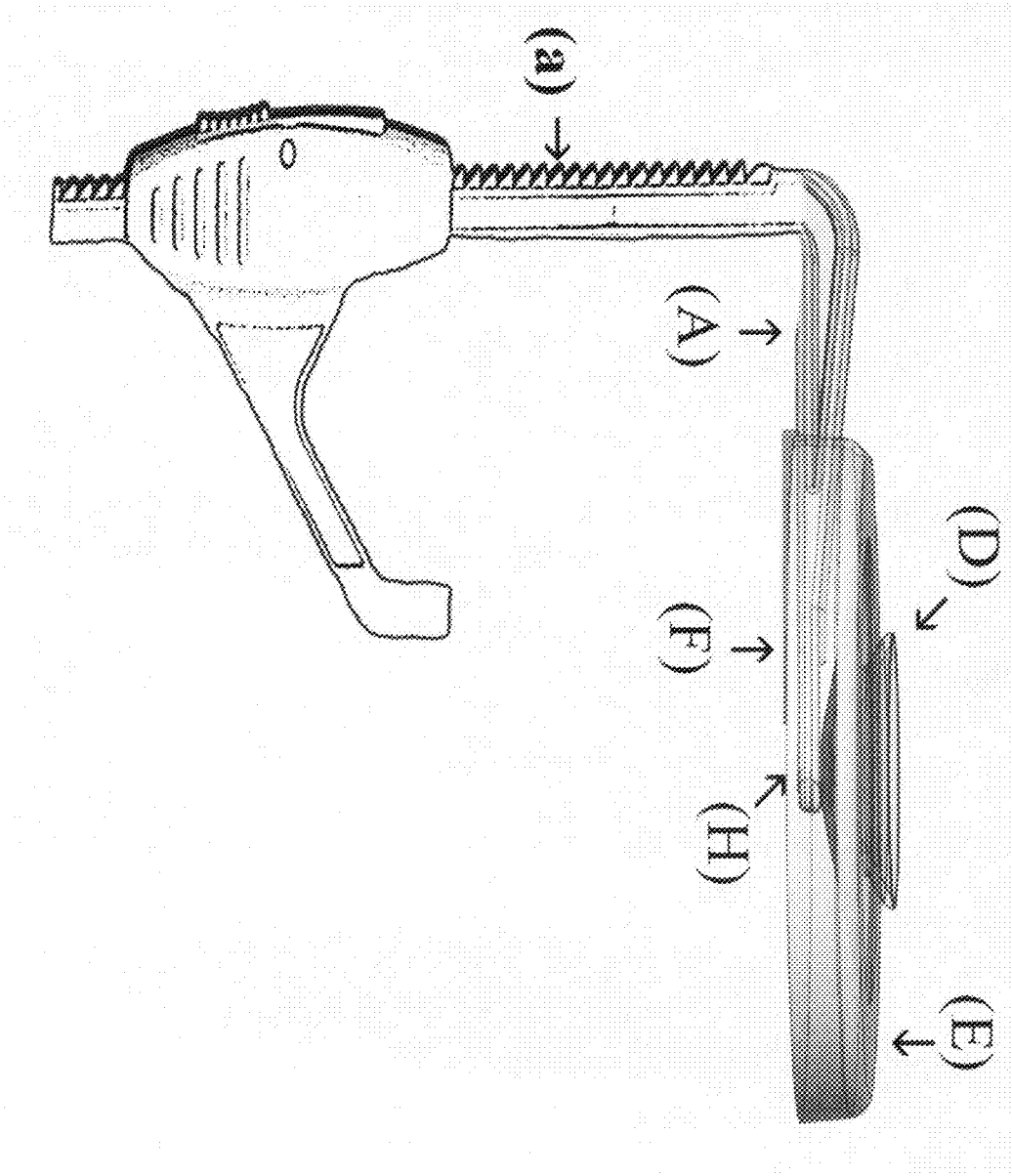
FIG. 12 is an illustration of a side view of a second alternate embodiment of a plate holder in open position. This is just one alternative of many that shows another option to securing device to the table or structure. The illustration which is one of many types of securing methods of the embodiment of FIG. 1.

FIG. 9 is an illustration of the embodiment of FIG. 1, dissembled into its individual component, including: C-shaped structure, making up a top arm (A), a side arm (C), and a bottom arm (B) FIG. 9 illustrates the C-shaped structure of the embodiment of FIG. 1;

FIG. 9(*a*) illustrates a side view of C-Shaped structure;

FIG. 9(*b*) illustrates a top view of C-Shaped structure;

FIG. 9(*c*) illustrates a front view of C-Shaped structure;

FIG. 9(*d*) illustrates a bottom view of C-Shaped structure;

FIG. 9(*e*) illustrates a back view of C-Shaped structure;

FIG. 10 is an is an illustration of the embodiment of FIG. 1, dissembled into individual component, including: skirt shaped structure, FIG. 10 illustrates the skirt structure of the embodiment of FIG. 1;

FIG. 10(*a*) illustrates a side view of skirt shaped structure;

FIG. 10(*b*) illustrates a top view of skirt shaped structure;

FIG. 11 is an illustration of the embodiment of FIG. 1, dissembled into individual component, including: screw, FIG. 11 illustrates the screw structure of the embodiment of FIG. 1;

FIG. 11(*a*) illustrates a side view of screw shaped structure;

FIG. 11(*b*) illustrates a top view of skirt shaped structure;

FIG. 12 is an illustration of a side view of a second alternate embodiment of a plate holder in open position. This is just one alternative of many that shows another option to securing device to the table or structure. The illustration which is one of many types of securing methods of the embodiment of FIG. 1 in FIG. 12 is using a teeth slide and lock mechanism.

FIG. 12(*a*) illustrates a a teeth slide and lock mechanism.

Hence, the embodiment of the plate holder provide numerous advantages over prior art. The plate holder firmly attaches a dish or article to a table or structure so that it is not easily removed or upset by a child or by movement due to wind or movement of the structure. The securing mechanism, which grips and attaches to a variety of surfaces and structures and does not depend on suction to attach to the structure, is made up of: a C-shaped structure making up a top arm (A), side arm (C) and bottom arm (B); a top arm (A) with a slip-resistant padding (F); and a screw (G) passing through the bottom arm (B). The slip-resistant padding (F) also protects the surfaces of the structure to which the plate holder attaches. Attached to the top arm (A) is a suction device (D) that can adhere to nearly all types of dishes. The ability to use the restaurant's dish eliminates the trouble of cleaning the dish after the meal and the unsanitary practice of carrying home a dirty dish or tray. The method of manufacturing the plate holder using molding to precisely form each component provides a simple but effective way to produce the plate holder. The plate holder may be easily and economically assembled and disassembled for convenient transportation and storage. The plate holder is easily attached and removed by an adult but is not easily removed by a child or by wind or movement of the structure to which it is attached. The plate holder can be safely manufactured and used and is made of durable materials that maintain proper function over repeated use and cleaning. The method of manufacturing the plate holder is effective and relatively simple and inexpensive.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

We claim:

1. A plate holder that is adapted to be attached to a structure comprising:

a flattened and tapered C-shaped structure making up a top arm, a side arm, and a bottom arm;

a suction device attached to the topside of the top arm for retaining a dish;

a detachable skirt mounted to the topside of the top arm, between the top arm and the suction device, to assist in balance of the attached dish;

a slip-resistant padding attached to the underside of the top arm;

a screw or other fastening mechanism with an endcap, the screw or other fastening mechanism passing through a hole on the bottom arm, passing up towards the top arm, so that the structure may be fastened to a table top when tightened.

2. The plate holder of claim 1, wherein the screw and the C-shaped structure, including the top arm, the side arm and the bottom arm, are made of a material selected from the group consisting of: metal, metal alloys, plastics, and composites.

3. The plate holder of claim 1, wherein the skirt is made of flexible and sturdy material, made of a material selected from the group consisting of: plastics and composites.

4. The plate holder of claim 1 wherein the suction device is made of a material selected from the group consisting of: plastics and composites.

5. The plate holder of claim 1 wherein the top arm has a notch, a divot or a hole at the outermost end in which the suction device is tightly secured.

6. The plate holder of claim 1 wherein the bottom arm has a hole through which the screw runs.

7. The plate holder of claim 1 wherein the screw has a handle and configured for a user to turn and grip.

8. The plate holder of claim 1 wherein the slip resistant padding is made of foam.

9. The plate holder of claim 1 wherein the suction device has a protrusion on the bottom, non/suction end with a rounded end in the shape of a mushroom head.

10. The plate holder of claim 1 wherein the skirt has a fold over lip of the same material around the outside of the skirt.

11. The plate holder of claim 1, wherein the fold over of the skirt extends downward and around the outside of the skirt but is omitted in a small portion of the skirt, whereupon the skirt sits on the top arm, the length of the omission corresponding with the width of the top arm.

* * * * *